US007045971B2

(12) United States Patent
Goto

(10) Patent No.: US 7,045,971 B2
(45) Date of Patent: May 16, 2006

(54) ILLUMINATING APPARATUS USING FULL-COLOR LEDS

(75) Inventor: Hiromitsu Goto, Kanagawa (JP)

(73) Assignee: Toki Corporation, Tokyo (JP)

( * ) Notice: Subject to any disclaimer, the term of this patent is extended or adjusted under 35 U.S.C. 154(b) by 71 days.

(21) Appl. No.: 10/780,765

(22) Filed: Feb. 19, 2004

(65) Prior Publication Data

US 2005/0141237 A1 Jun. 30, 2005

(30) Foreign Application Priority Data

Dec. 26, 2003 (JP) ..... 2003-435747

(51) Int. Cl.
*G05I 1/00* (2006.01)
*F21S 4/00* (2006.01)

(52) U.S. Cl. ..... 315/291; 362/800

(58) Field of Classification Search ..... 315/291, 315/307, 185 R, 185 S; 362/800
See application file for complete search history.

(56) References Cited

U.S. PATENT DOCUMENTS

2002/0067290 A1* 6/2002 Peet et al. ..... 340/907
2004/0213540 A1* 10/2004 Gotfried ..... 385/147
2005/0024877 A1* 2/2005 Frederick ..... 362/277
2005/0057942 A1* 3/2005 Mako et al. ..... 362/554

FOREIGN PATENT DOCUMENTS

JP 2002-353519 12/2002

OTHER PUBLICATIONS

Patent Abstracts of Japan, Publication No. 2002-353519, Published Dec. 6, 2002, LED Array and Display Device Using the Same, 1 page.

* cited by examiner

*Primary Examiner*—Trinh V Dinh
*Assistant Examiner*—Minh Dieu A
(74) *Attorney, Agent, or Firm*—Dowell & Dowell, P.C.

(57) ABSTRACT

An illuminating apparatus according to the present invention comprises a controller, a power supply cable and a plurality of light-emitting units. The plurality of light-emitting units shown are a first light-emitting unit, a second light-emitting unit, a third light-emitting unit, a fourth light-emitting unit, a fifth light-emitting unit, a sixth light-emitting unit, a seventh light-emitting unit and an eighth light-emitting unit. Each light-emitting unit is provided with a red LED, a green LED and a blue LED. A diode is connected to the red LED whose forward voltage is lower.

10 Claims, 3 Drawing Sheets

ILLUMINATING APPARATUS USING FULL-COLOR LEDS

BACKGROUND OF THE INVENTION

1. Field of the Invention

The present invention relates to illuminating apparatus, and it particularly relates to a technology by which to maintain the desirable state of light generation.

2. Description of the Related Art

LEDs (Light Emitting Diodes) are known as relatively low-priced light-emitting elements. LEDs come in various types that emit light of red, green and various other colors, and special attention is being directed to the blue LEDs, which have been finding practical application in recent years. With three primary colors ready now, it is possible to produce full-color display apparatuses using LEDs (see, for example, Reference (1) in the following Related Art List), and a variety of other applications are expected for LEDs.

RELATED ART LIST (1) Japanese Patent Application Laid-Open No. 2002-353519.

Of the LEDs for three primary colors used for full-color light emissions, the red LED requires a lower forward voltage (VF) than the blue and green LEDs. When a large number of LEDs are connected to a cable dozens of meters long, a difference results in current value between the ends of the cable due to a voltage drop, and hence there will be differences in light intensity of the LEDs. Moreover, since the voltage drop varies with the forward voltages of different LED colors, there may occur differences in color tone or hue of the emitted colors, which are produced by mixing red, green and blue, between the ends of the cable.

SUMMARY OF THE INVENTION

The present invention has been made in recognition of the foregoing circumstances and an object thereof is to provide a technology for realizing uniform color tones of light emitted by an illuminating apparatus using LEDs.

In order to solve the above problems, an illuminating apparatus according to a preferred embodiment of the present invention includes: a cable for supplying power; a plurality of light-emitting units which are connected on the cable and provided thereon at predetermined intervals; and a controller, connected to an end of the cable, which controls power supply to the plurality of light-emitting units connected via the cable. And the light-emitting unit contains a plurality of light emitting elements having different emission colors, respectively, and a diode is connected to a light emitting element, among the plurality of light emitting elements, which requires relatively low voltage for light emission.

Here, the "light emitting element" may be a light emitting diode (LED) or an organic light emitting diode (OLED). In the case of LED, three LEDs corresponding respectively to RGB (red, green and blue colors), for instance, may serve the purpose. The "light-emitting unit" may illuminate in colors expressed with mixed RGB colors. "A light emitting element which requires relatively low voltage for light emission" means the element, in the case of LED, for example, in which the forward voltage is further low. And, for example, it corresponds to a red LED whose forward voltage is lower than a green LED and a blue LED.

According to this embodiment, a diode is newly provided and connected to a light emitting element, among a plurality of light emitting elements contained in a light-emitting unit, which requires relatively low voltage for light emission. The voltage drop caused by the diode and the light emitting element is larger than that caused by the light emitting element alone. The degree of such voltage drop becomes close to the degree of voltage drop in the other light emitting elements, so that a value of current flowing thereto also becomes close to the value of current flowing to the other light emitting elements. Thus, if a plurality of light-emitting units are connected to a relatively long cable, the difference in the voltage drop and current amount therebetween per emission color is reduced. As a result thereof, the color tones or hues of emission colors in the plurality of light-emitting units become uniform. Ideally, it is preferable that the value of the diode be set such that voltage drop for each emission color becomes approximately equal.

Another preferred embodiment according to the present invention relates also to an illuminating apparatus. This apparatus includes: a cable for supplying power; a plurality of light-emitting units which are connected on the cable and provided thereon at predetermined intervals; and a controller, connected to an end of the cable, which controls power supply to the plurality of light-emitting units connected via the cable. And the light-emitting unit contains a plurality of light emitting elements having different emission colors, respectively, and a current regulation diode is connected to at least one of the plurality of light emitting elements so that voltage drop for each of the plurality of light emitting elements is equal to one another.

According to this embodiment, the voltage drop for each emission color becomes constant by providing and connecting a current regulation diode with a light emitting element. By employing the current regulation diode, the voltage drop and the current value can be set most accurately and properly, thus enabling the color tone of emission color for each light-emitting unit to be uniform.

It is to be noted that any arbitrary combination or rearrangement of the above-described structural components and the expressions changed between a method, an apparatus, a system and so forth are all effective as and encompassed by the present embodiments.

Moreover, this summary of the invention does not necessarily describe all necessary features so that the invention may also be sub-combination of these described features.

DETAILED DESCRIPTION OF THE INVENTION

The invention will now be described based on the following embodiments which do not intend to limit the scope of the present invention but exemplify the invention. All of the features and the combinations thereof described in the embodiments are not necessarily essential to the invention.

FIRST EMBODIMENT

An illuminating apparatus according to a first embodiment is, for instance, what is called "tape light", an outdoor or indoor decorative illumination used in commercial spaces.

Figure 1:
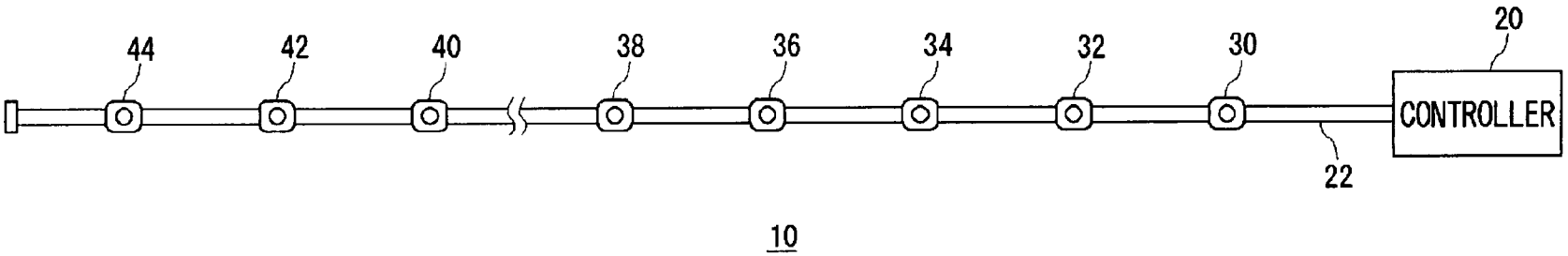
FIG. 1 shows a general structure of an illuminating apparatus.

FIG. 1 shows a general structure of an illuminating apparatus. The illuminating apparatus 10 is comprised of a controller 20, a power supply cable 22 and a plurality of light-emitting units. The plurality of light-emitting units shown in FIG. 1 are a first light-emitting unit 30, a second light-emitting unit 32, a third light-emitting unit 34, a fourth light-emitting unit 36, a fifth light-emitting unit 38, a sixth light-emitting unit 40, a seventh light-emitting unit 42 and an eighth light-emitting unit 44.

The power supply cable 22 is, for example, a cable about 20 meters long, formed in a flat tape-like structure containing four conductors disposed in parallel with one another with a resin member covering them. The light-emitting units are connected to the power supply cable 22 and provided thereon at predetermined intervals of about 10 cm for instance. The controller 20 is connected to one end of the power supply cable 22, and electric power is supplied to each of the plurality of light-emitting units from the controller 20 via the power supply cable 22. The controller 20 may be structured either integrally with or separately from the power supply source.

The plurality of light-emitting units are each provided with three color LEDs corresponding to the three primary colors RGB (red, green and blue) and emit light according to the power supply and control from the controller 20. At this time, the three color LEDs emit light with different intensities according to the voltages applied thereto and can also realize full-color light emission through a combination of the intensities of the three colors. The plurality of light-emitting units provided on the power supply cable 22 emit light of the same color under the control from the controller 20. The controller 20 may change the emission color gradually by changing the duty ratio and/or phase of the voltage to be applied to each of the LEDs.

Since the power supply cable 22 is of a considerable length, the resulting voltage drop causes a slight difference in light intensity between the first light-emitting unit 30 and the eighth light-emitting unit 44. For a single-color illumination, this kind of difference in light intensity does not pose any serious problem because such a slight difference cannot usually be recognized by the human eye. For illumination with a mixed color of RGB, however, there may result differences in the tone or hue of the emitted color as will be described below. And these differences in the tone or hue of the emitted color can be easily recognized by the human eye.

The LEDs for RGB, respectively, require different forward voltages (VFs). For instance, whereas the red LED requires approximately 1.9 V, the green and the blue LED require approximately 3.5 V. In other words, voltage drop varies with the emission color, so that the effects of voltage drops at the first light-emitting unit 30 and at the eighth light-emitting unit are different for the respective LEDs. Accordingly, they result in differences in color tone or hue when the three colors are mixed. In the present embodiment, therefore, a diode is added to the red LED whose forward voltage is lower, and it is so arranged that the voltage drop at the diode and the red LED becomes nearly equal to that at the other LEDs. This nearly equalizes the effects of voltage drop for the different colors, thereby substantially eliminating differences in color tone between the plurality of light-emitting units.

Figure 2:
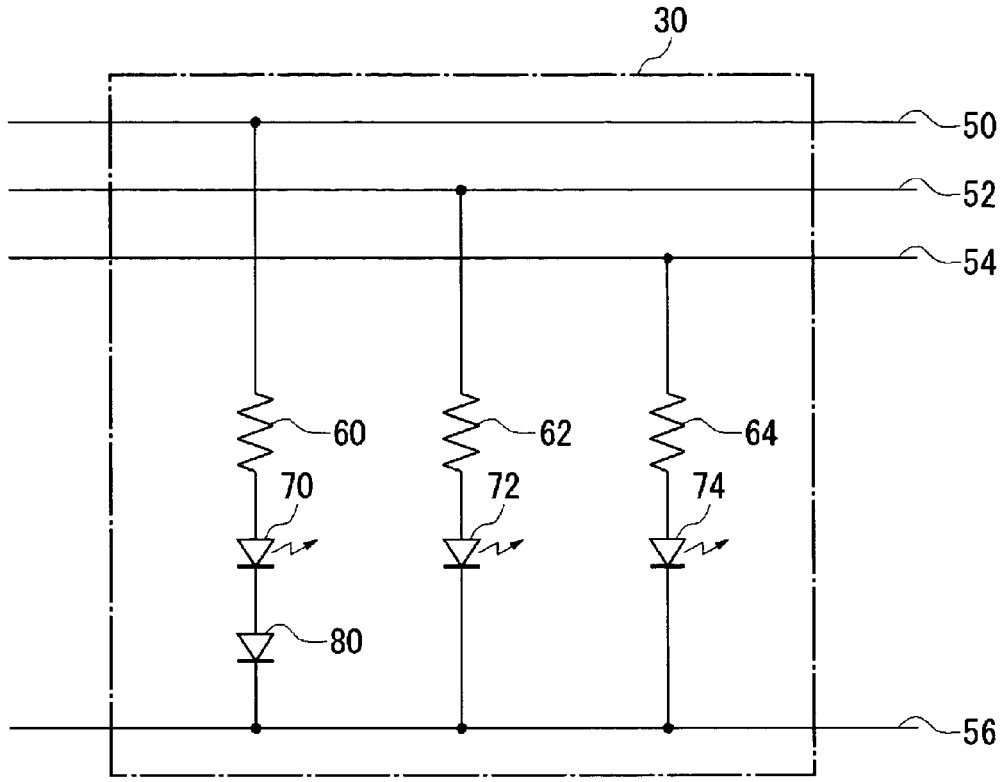
FIG. 2 shows an electrical structure of a first light-emitting unit according to a first embodiment of the present invention.

FIG. 2 shows an electrical structure of a first light-emitting unit 30. The second to eighth light-emitting units 32, 34, 36, 40, 42 and 44 have the same structure as the first light-emitting unit and therefore the description thereof will be omitted. The first light-emitting unit 30 includes a resistance for red color 60 (hereinafter referred to also as "red resistance"), a resistance for green color 62 (hereinafter referred to also as "green resistance"), a resistance for blue color 64 (hereinafter referred to also as "blue resistance"), a red LED 70, a green LED 72, a blue LED 74 and an auxiliary diode 80. A power supply line for the red LED 50 (hereinafter referred to also as "red power supply line"), a power supply line for the green LED 52 (hereinafter referred to also as "green power supply line"), a power supply line for the blue LED 54 (hereinafter referred to also as blue power supply line) and a common line 56 are the four conductors contained in the power supply cable 22.

The red LED 70, the green LED 72 and the blue LED 74 are light emitting diodes that emit red, green and blue colors, respectively, and various colors can be produced by mixing these colors. The red resistance 60, the green resistance 62 and the blue resistance 64 are connected to the red LED 70, the green LED 72 and the blue LED 74, respectively, and prevent the burnout thereof by regulating current flowing thereto.

The red resistance 60, the red LED 70 and the auxiliary diode 80 are connected in series. That is, one end of the red resistance 60 is connected to the red power supply line 50, whereas the other end of the red resistance 60 is connected to an anode of the red LED 70. A cathode of the red LED 70 is connected to an anode of the auxiliary diode 80. A cathode of the auxiliary diode 80 is connected to the common line 56. And the common line 56 is grounded.

The green resistance 62 and the green LED 72 are connected in series. That is, one end of the green resistance 62 is connected to the green power supply line 52, whereas the other end of the green resistance 62 is connected to an anode of the green LED 72. And a cathode of the green LED 72 is connected to the common line 56.

The blue resistance 64 and the blue LED 74 are connected in series. That is, one end of the blue resistance 64 is connected to the blue power supply line 54, whereas the other end of the blue resistance 64 is connected to an anode of the blue LED 74. And a cathode of the blue LED 74 is connected to the common line 56.

The forward voltage for the red LED 70 is approximately 1.9 V, and that for the green LED 72 and the blue LED 74 is approximately 3.5 V. In other words, the voltage required by the red LED 70 to emit light is relatively low as compared to that required by the green LED 72 or the blue LED 74. The auxiliary diode 80 employed is, for instance, one whose forward voltage is about 1.6 V. Accordingly, the currents flowing to the red LED 70, the green LED 72 and the blue LED 74, respectively, become nearly equal, and the voltage drops for the respective colors also become nearly equal. As a result, there will be little difference in the tone of emitted colors since variation in the effects of voltage drop for each color is reduced to almost none between the first light-emitting unit 30 and the eighth light-emitting unit 44, which are located close to the respective ends of the power supply cable 22.

SECOND EMBODIMENT

Figure 3:
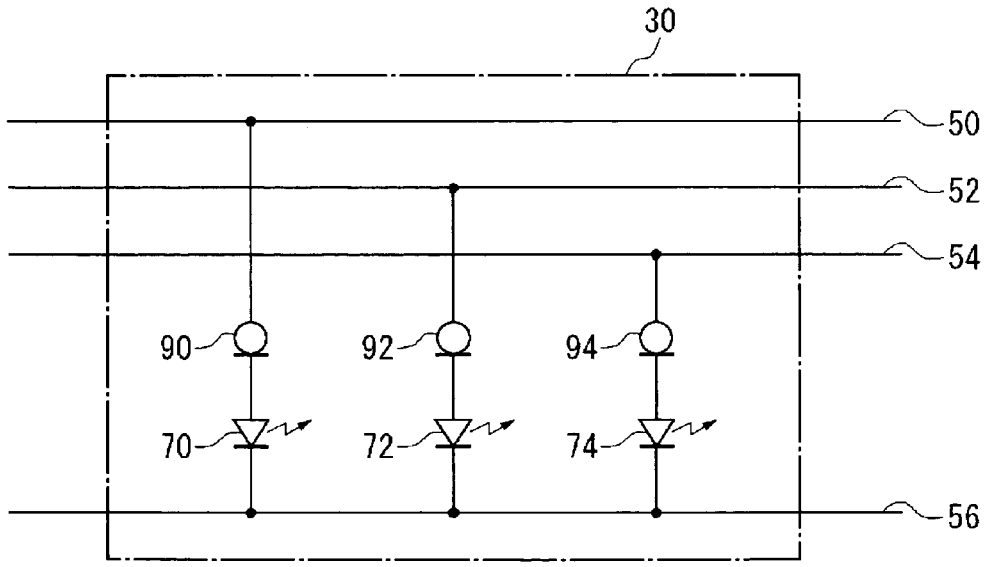
FIG. 3 shows an electrical structure of a first light-emitting unit according to a second embodiment of the present invention.

FIG. 3 shows an electrical structure of a first light-emitting unit 30 according to a second embodiment. An illuminating apparatus of this second embodiment differs from the first embodiment in that the difference in the tone of emission colors is eliminated by using current regulation diodes. That is, current regulation diodes 90, 92 and 94 are provided in place of the red resistance 60, the green resistance 62 and the blue resistance 64, respectively, and they are set such that the currents flowing to the red LED 70, the green LED 72 and the blue LED 74 become equal. In this manner, current regulation diodes can also make the current for the LEDs of each color constant. As a result, there will be little difference in the tone of emitted colors since variation in the effects of voltage drop for each color is reduced to almost none between the first light-emitting unit 30 and the eighth light-emitting unit 44, which are located close to the respective ends of the power supply cable 22.

It is to be noted here that the current regulation diodes are 20 or 30 times more expensive than the auxiliary diode 80 used in the first embodiment, although they can provide more accurate control. In other words, the first embodiment possesses considerable merit in that it can create a uniform tone of colors emitted by the light-emitting units simply by connecting an inexpensive diode.

THIRD EMBODIMENT

Figure 4:
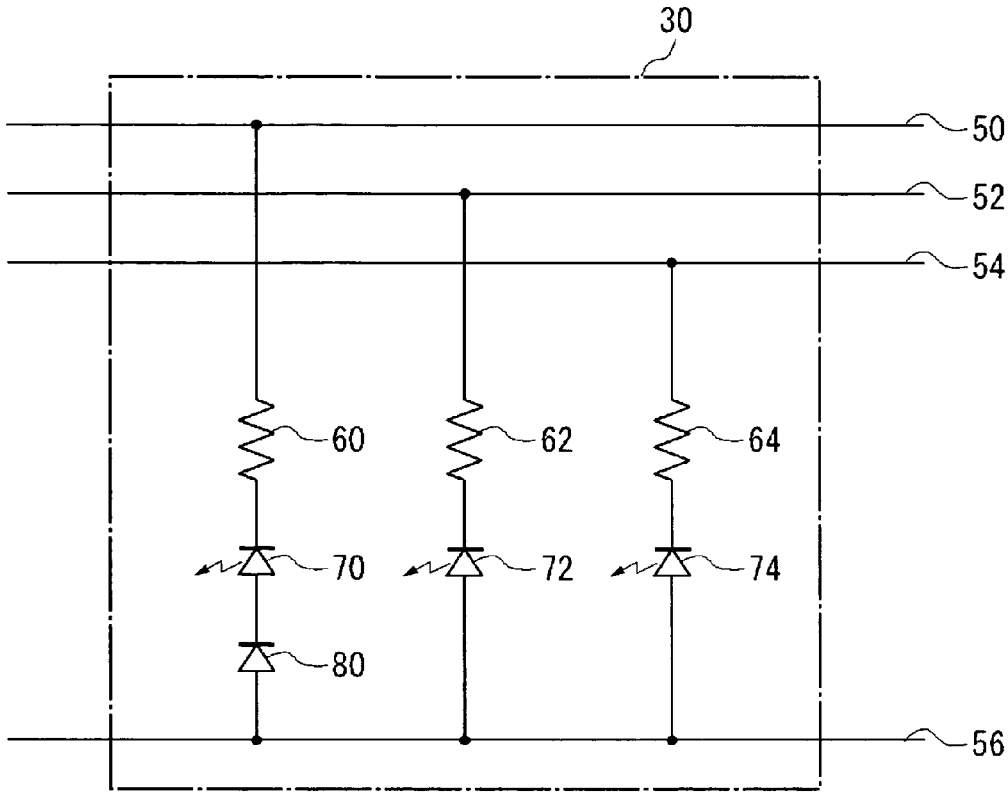
FIG. 4 shows an electrical structure of a first light-emitting unit according to a third embodiment of the present invention.

FIG. 4 shows an electrical structure of a first light-emitting unit 30 according to a third embodiment. An illuminating apparatus according to this third embodiment differs from the first embodiment in that the red LED 70, the green LED 72, the blue LED 74 and the auxiliary diode 80 are connected in such a direction as to have the opposite polarity. That is, the cathodes of the red LED 70, the green LED 72 and the blue LED 74 are connected to one end of the red resistance 60, the green resistance 62 and the blue resistance 64, respectively, and the anode of the red LED 70 is connected to the cathode of the auxiliary diode 80. The anodes of the green LED 72, the blue LED 74 and the auxiliary diode 80 are connected to the common line 56. This arrangement can also produce the same advantageous effect as the first embodiment.

The present invention has been described based on the embodiments which are only exemplary. It is understood by those skilled in the art that there exist other various modifications to the combination of each component or each processing step described above and that such modifications are encompassed by the scope of the present invention.

What is claimed is:

1. An illuminating apparatus, including:

a cable for supplying power;

a plurality of light-emitting units which are connected on said power cable and provided thereon at predetermined intervals; and a controller, connected to an end of said cable, which controls power supply to the plurality of light-emitting units connected via said cable, wherein the light-emitting unit contains a plurality of light-emitting elements having different emission colors, respectively and wherein a diode is connected to a light emitting element, among the plurality of light emitting elements, which requires relatively low voltage for light emission.

2. An illuminating apparatus according to claim 1, wherein the diode is structured such that a voltage drop caused by the light-emitting element which requires relatively low voltage for light emission and the diode becomes approximately equal to that caused by the other light emitting elements.

3. An illuminating apparatus according to claim 2, wherein the plurality of light emitting elements are a light emitting element that illuminates in red color, a light emitting element that illuminates in green color and a light emitting element that illuminates in blue color and wherein the diode is connected to the red light emitting element.

4. An illuminating apparatus according to claim 3, wherein the light emitting elements are light emitting diodes.

5. An illuminating apparatus according to claim 2, wherein the light emitting elements are light emitting diodes.

6. An illuminating apparatus according to claim 1, wherein the plurality of light emitting elements are a light emitting element that illuminates in red color, a light emitting element that illuminates in green color and a light emitting element that illuminates in blue color and wherein the diode is connected to the red light emitting element.

7. An illuminating apparatus according to claim 6, wherein the light emitting elements are light emitting diodes.

8. An illuminating apparatus according to claim 1, wherein the light emitting elements are light emitting diodes.

9. An illuminating apparatus, including:

a cable for supplying power;

a plurality of light-emitting units which are connected on said power cable and provided thereon at predetermined intervals; and a controller, connected to an end of said cable, which controls power supply to the plurality of light-emitting units connected via said cable, wherein the light-emitting unit contains a plurality of light emitting elements having different emission colors, respectively, and wherein a current regulation diode is connected to at least one of the plurality of light emitting elements so that voltage drop for each of the plurality of light emitting elements is equal to one another.

10. An illuminating apparatus according to claim 9, wherein the light emitting elements are light emitting diodes.

* * * * *